US005454362A

United States Patent [19]

Cook

[11] Patent Number: 5,454,362

[45] Date of Patent: Oct. 3, 1995

[54] ARROW HOLDING AND GUIDING DEVICES FOR BOWS

[76] Inventor: Curtis Cook, 554 E. Main St., Ionia, Mich. 48846

[21] Appl. No.: 136,907

[22] Filed: Oct. 18, 1993

[51] Int. Cl.[6] ..... F41B 5/22; F41B 5/00

[52] U.S. Cl. ..... 124/44.5; 124/41.1

[58] Field of Search ..... 124/44.5, 41.1, 124/23.1, 24.1, 25.6, 88, 86, 80

[56] References Cited

U.S. PATENT DOCUMENTS

| | | | |
|---|---|---|---|
| 2,691,974 | 10/1954 | Nelson | 124/44.5 |
| 2,743,716 | 5/1956 | Wendt | 124/24.1 X |
| 2,777,435 | 1/1957 | Brooks | 124/44.5 X |
| 4,038,960 | 8/1977 | Ludwig | 124/44.5 |
| 4,577,612 | 3/1986 | Zell | 124/45.5 |
| 4,662,346 | 5/1987 | Laffin | 124/44.5 |
| 4,879,988 | 11/1989 | Larson | 124/41.1 |
| 5,009,215 | 4/1991 | Ludwig | 124/44.5 |
| 5,107,819 | 4/1992 | Pugh | 124/88 X |
| 5,259,359 | 11/1993 | Meredith | 124/44.5 X |

*Primary Examiner*—Randolph A. Reese
*Assistant Examiner*—Harry C. Kim

[57] ABSTRACT

A device for holding an arrow to an overdraw rest system of a bow comprising a first plate; a second plate; a mechanism for coupling the first plate to the second plate to define an L-shaped configuration; a flapper stop pin coupled to the edge of the first plate opposite the edge where the first and second plates are coupled, the pin extending therefrom; a flapper having a first end, second end, and intermediate portion therebetween, the first end having a adapted to be rotatably coupled to the first plate near the flapper stop pin, the second end adapted to hold the shaft of an arrow securely to an overdraw rest system until the arrow is ready to fire, whereupon firing, the rubber flapper releases its hold of the arrow, causing the second end to rotate about the first end until the intermediate portion makes contact with the flapper stop pin, whereby ensuring that the flapper does not make contact with the arrow and alter its direction of flight; a mechanism for rotatably coupling the flapper to the plate; and a mechanism for coupling the second plate to an overdraw rest system.

1 Claim, 3 Drawing Sheets

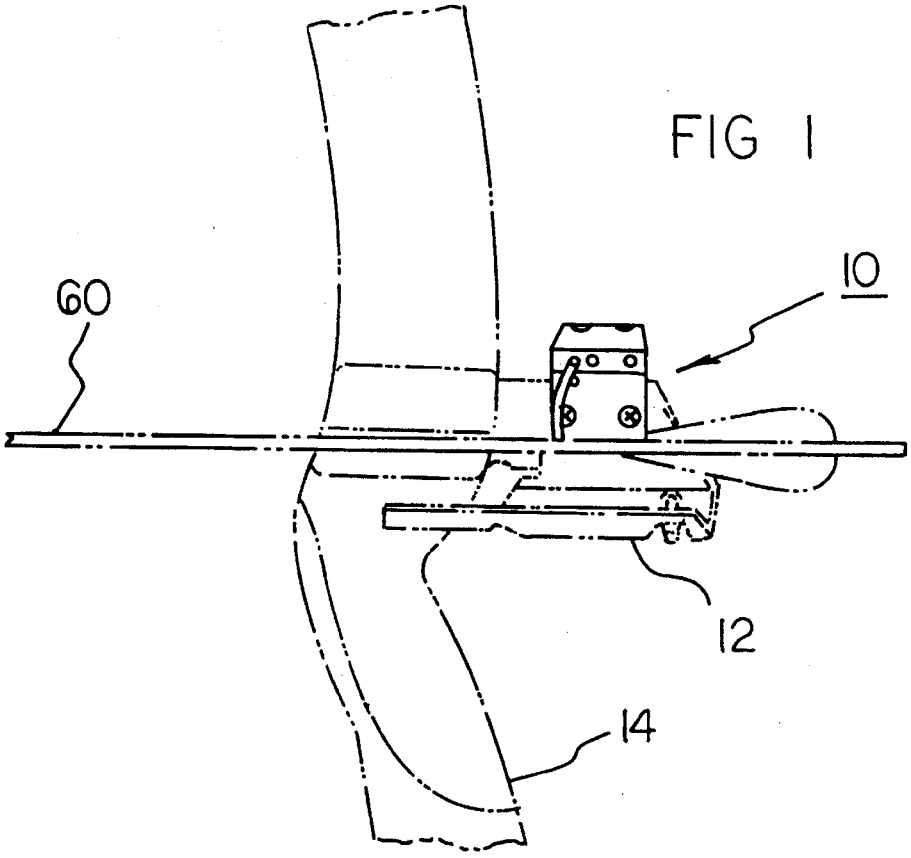
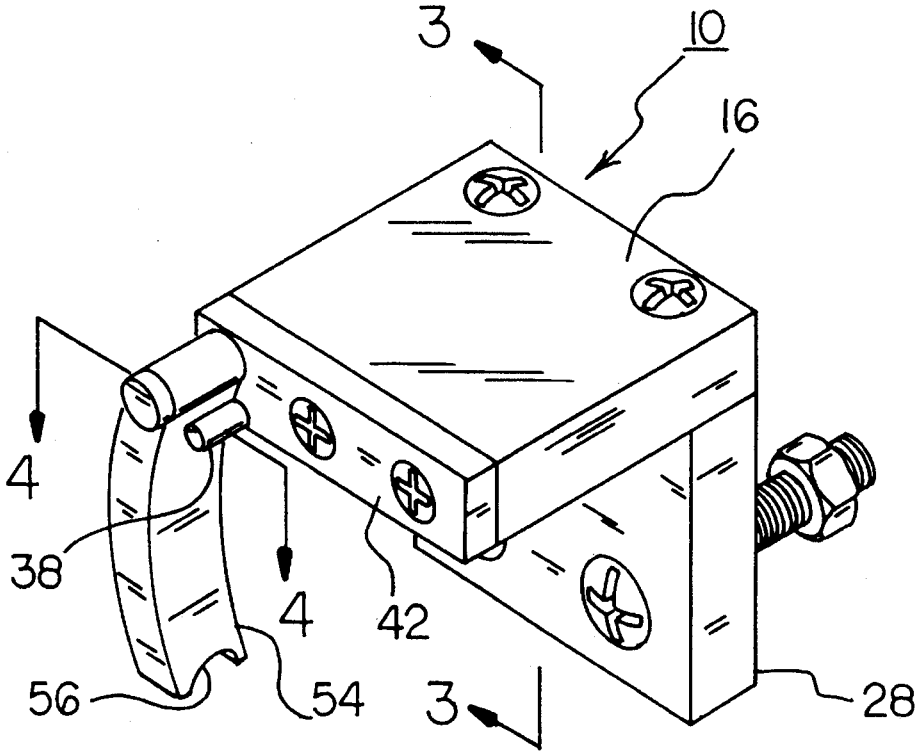
FIG 2

ARROW HOLDING AND GUIDING DEVICES FOR BOWS

BACKGROUND OF THE INVENTION

1. Field of the Invention

The present invention relates to arrow holding and guiding devices for bows and more particularly pertains to devices which may be used to hold arrows to an overdrawn rest system of a bow.

2. Description of the Prior Art

The use of bow arrow guiding devices is known in the prior art. More specifically, devices heretofore devised and utilized for the purpose of guiding arrows shot from a bow are known to consist basically of familiar, expected and obvious structural configurations, notwithstanding the myriad of designs encompassed by the crowded prior art which have been developed for the fulfillment of countless objectives and requirements.

For example, an adjustable arrow rest for using up to 2 arrows is illustrated in U.S. Pat. No. 5,052,364 to Martin and an arrow guide is illustrated in U.S. Pat. No. 4,924,841 to Smith.

An arrow rest/overdraw apparatus for an archery bow as described in U.S. Pat. No. 5,022,378 is a device that supports an arrow for shooting at a support location between the draw string full-draw rearward and draw string full-forward travel position.

Other relevant patents include U.S. Pat. Nos. 4,809,670 to Simo; 4,119,078 to Wilson and Des. 266,179 to Peck.

In this respect, the arrow holding and guiding devices for bows according to the present invention substantially departs from the conventional concepts and designs of the prior art, and in so doing provides an apparatus primarily developed for the purpose of assisting archers.

None of these devices, however, operate in conjunction with an overdraw rest system to hold an arrow in a rest position until ready to fire, providing a hunter the capability to be ready to shoot at times due to the fact that the arrow is held in the firing position, whereas an arrow guide only provides an alignment mechanism in support of firing preparation. Having an arrow held in a firing position provides a hunter the capability to maneuver into heavy brush in search of game, ready to engage the game at once. Furthermore, the holding mechanism prevents undue noise that results in a conventional guiding system when the arrow falls off the bow arrow rest.

Therefore, it can be appreciated that there exists a continuing need for new and improved arrow holding device which can be utilized with an overdraw bow system. In this regard, the present invention substantially fulfills this need.

SUMMARY OF THE INVENTION

In view of the foregoing disadvantages inherent in the known types of arrow guides now present in the prior art, the present invention provides an improved device for holding an arrow to an overdrawn rest system. As such, the general purpose of the present invention, which will be described subsequently in greater detail, is to provide a new and improved arrow holding device which has all the advantages of the prior art and none of the disadvantages.

To attain this, the present invention essentially comprises a device for holding an arrow to an overdraw rest system of a bow comprising an essentially rectangular and black anodized aluminum first plate having a top surface and a bottom surface, opposing inner and outer edges, and opposing leading and trailing edges, the plate further including two holes disposed through the plate and adjacent to the inner edge with each hole adapted for receipt of a bolt and two threaded holes disposed on the outer edge, each hole adapted for receipt of a bolt; an essentially rectangular black anodized aluminum second plate having an outer surface and an inner surface, opposing upper and lower edges, and opposing leading and trailing edges, the plate further including two threaded holes disposed on the upper edge with each hole adapted for receipt of a bolt and with the holes symmetrically aligned with the holes adjacent to the inner edge of the first plate and two holes disposed through the plate and adjacent to the lower edge with each hole adapted for receipt of a bolt; two threaded bolts, each bolt disposed through a hole adjacent to the inner edge of the first plate and through a hole on the upper edge of the second plate, coupling the upper edge of the second plate to the bottom surface of the first plate, defining an L-shaped configuration such that the bottom surface of the first plate is adjacent to the inner surface of the second plate, with the leading edges of the plates defining a common leading edge and the trailing edges of the plates defining a common trailing edge; a flapper stop pin coupled to the outer edge of the first plate and extending therefrom; a black plastic plate adapted to be coupled to the outer edge of the first plate with the flapper stop pin extending therethrough, the plastic plate further including two plate mounting holes disposed thereon with each hole adapted to receive a bolt and with the holes symmetrically aligned with the two holes disposed on the outer edge of the first plate and a flapper mounting hole disposed between the plate mounting holes and leading edge of the first plate, the hole adapted to receive a bolt; two threaded bolts, each bolt disposed through a plate mounting hole on the plastic plate and through a hole on the outer edge of the first plate, coupling the inner surface of the plastic plate to the outer surface of the first plate; a rubber flapper having a first end, second end, and intermediate portion therebetween, the first end having a pivot hole disposed therethrough and adapted to be rotatably coupled to the outer surface of the plastic plate between the flapper stop pin and the leading edge of the first plate, the second end adapted to hold the shaft of an arrow securely to an overdraw rest system until the arrow is ready to fire, whereupon firing, the rubber flapper releases its hold of the arrow, causing the second end to rotate about the pivot hole until the intermediate portion makes contact with the flapper stop pin, thereby ensuring that the flapper does not make contact with the arrow and alter its direction of flight; a cylindrical steel sleeve disposed within the rubber flapper hole, the steel sleeve adapted to protect the rubber flapper hole from excessive wear; a self-locking and threaded bolt disposed through the flapper mounting hole in the plastic plate, rotatably coupling the steel sleeve and rubber flapper to the plastic plate; and two threaded bolts with cooperative nuts, each bolt disposed through a hole adjacent to the bottom edge of the second plate, the bolts adapted to be coupled to an overdraw rest system with the nuts.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new device for holding arrows to an overdraw rest system which has all the advantages of the prior art and none of the disadvantages.

It is another object of the present invention to provide a new and improved arrow holder which may be easily and efficiently manufactured and marketed.

It is a further object of the present invention to provide a new arrow holder which is of a durable and reliable construction.

An even further object of the present invention is to provide a new and improved arrow holder which is susceptible of a low cost of manufacture with regard to both materials and labor, and which accordingly is then susceptible of low prices of sale to the consuming public, thereby making such an arrow holder economically available to the buying public.

Still yet another object of the present invention is to provide a new and improved arrow holder which provides in the apparatuses and methods of the prior art some of the advantages thereof, while simultaneously overcoming some of the disadvantages normally associated therewith.

Still another object of the present invention is to provide a new arrow holder that eliminates undue noise since the arrow cannot fall off the rest.

Yet another object of the present invention is to provide a new arrow holder that enables firing at once.

Even still another object of the present invention is to provide a new arrow holder that provides the hunter greater mobility in the field as well as enhancing his ability to quickly engage game.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a side elevation view of the arrow holder shown mounted on a bow.

FIG. 2 is a perspective view of the arrow holder device shown in FIG. 1.

DESCRIPTION OF THE PREFERRED EMBODIMENT

Figure 3:
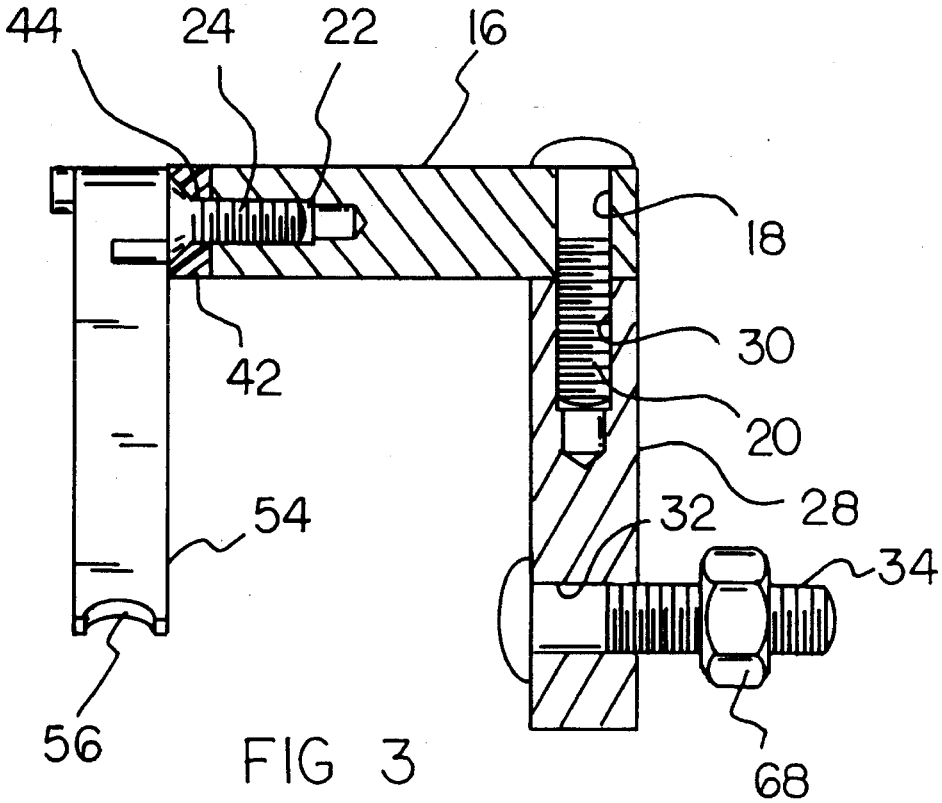
FIG. 3 is a cross sectional view of the arrow holder taken through line 3—3 if FIG. 2.
Figure 4:
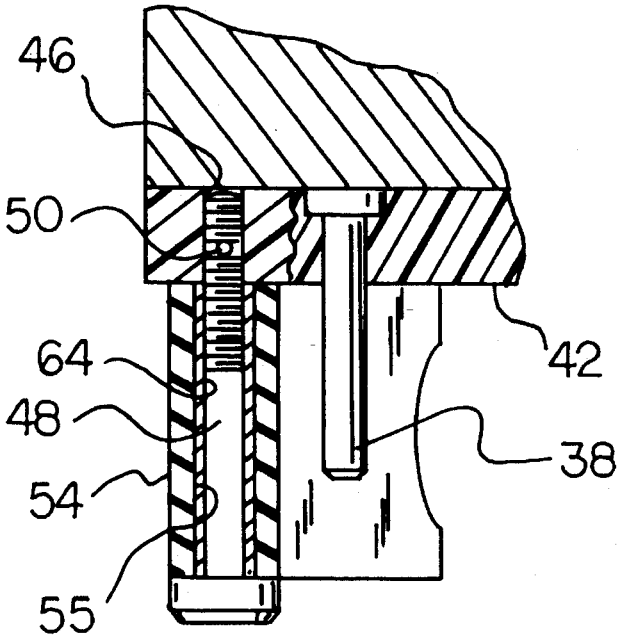
FIG. 4 is a cross sectional view of the flapper and a portion of its supporting plate taken along line 4—4 of FIG. 3.

With reference now to the drawings, and in particular to FIG. 1 thereof, a new arrow holder for an overdraw rest system of a bow embodying the principles and concepts of the present invention and generally designated by the reference numeral 10 will be described.

More specifically, the device 10 for holding an arrow to an overdraw rest system 12 of a bow 14 is best seen in FIGS. 1 and 2. The device 10 includes an essentially rectangular and black anodized aluminum first plate 16. The plate has a top surface and a bottom surface, opposing inner and outer edges, and opposing leading and trailing edges. The plate further includes two holes 18 disposed through the plate adjacent to the inner edge. Each hole is adapted for receipt of a bolt 20. Two additional threaded holes 22, disposed on the outer edge are also, adapted for receipt of a bolt 24.

An essentially rectangular black anodized aluminum second plate 28 is also provided. It has an outer surface and an inner surface, opposing upper and lower edges, and opposing leading and trailing edges. The plate 28 further includes two threaded holes 30 disposed on the upper edge with each hole adapted for receipt of the bolt 20. The holes 30 are symmetrically aligned with the holes 18 adjacent to the inner edge of the first plate. Two holes 32 are disposed through the plate 28 and adjacent to the lower edge with each adapted for receipt of a bolt 34. Aluminum is the preferred material since it is light weight and strong. Black is the preferred color so as to resist glare for an archer.

The two threaded bolts 20 are disposed through the hole 18 adjacent to the inner edge of the first plate 16 and through a hole 30 on the upper edge of the second plate 28 for coupling the upper edge of the second plate to the bottom surface of the first plate. This defines an L-shaped configuration such that the bottom surface of the first plate is adjacent to the inner surface of the second plate. The leading edges of the plates define a common leading edge, and the trailing edges of the plates define a common trailing edge.

A flapper stop pin 38 is coupled to the outer edge of the first plate and extending therefrom for a purpose to be later described.

A further element of the device is a plastic plate 42, black to reduce glare. The plate is coupled to the outer edge of the first plate 16 with the flapper stop pin 38 extending therethrough. The plastic plate 42 includes two plate mounting holes 44 disposed thereon with each hole being adapted to receive a bolt 24 and with the holes symmetrically aligned with the two holes 22 disposed on the outer edge of the first plate 16. The plastic plate 42 also includes a flapper mounting hole 46 disposed between the plate mounting holes and leading edge of the first plate. The hole 46 is adapted to receive a commercially available self locking bolt 48 with a nylon patch 50.

Also included as part of the device are two additional threaded bolts 24. Each bolt 24 is disposed through a plate mounting hole 44 on the plastic plate and through a hole 22 on the outer edge of the first plate 16. Bolts 24 couple the inner surface of the plastic plate 42 to the outer surface of the first plate 16.

The key component of the device 10 is the rubber flapper 54. Flapper 54 has a first end, second end, and intermediate portion therebetween. The first end has a pivot hole 55 disposed therethrough which is adapted to be rotatably coupled to the outer surface of the plastic plate between the flapper stop pin and the leading edge of the first plate. The second end of the flapper 54 is formed with a curve 56 adapted to hold the shaft of an arrow 60, from above, securely to an overdraw rest system 12 until the arrow is ready to fire. Upon firing, the rubber flapper 54 releases its hold of the arrow, causing the second end to rotate about the pivot hole 55 until the intermediate portion makes contact with the flapper stop pin 38. This ensures that the flapper 54 does not make contact with the moving arrow and alter its direction of flight.

A cylindrical steel sleeve 64 is disposed within the rubber flapper hole 55. The sleeve 64 is adapted to protect the rubber flapper hole from excessive wear.

The self-locking and threaded bolt 48 is disposed through the flapper mounting hole 55 in the plastic plate 42. Bolt 48 rotatably couples the sleeve 64 and rubber flapper 44 to the plastic plate 42.

Lastly, the two threaded bolts 34 with cooperative nuts 68, are disposed through holes 32 adjacent to the bottom edge of the second plate 28. The bolts 34 are adapted to be coupled to an overdraw rest system 12 with the nuts 68.

Figure 5:
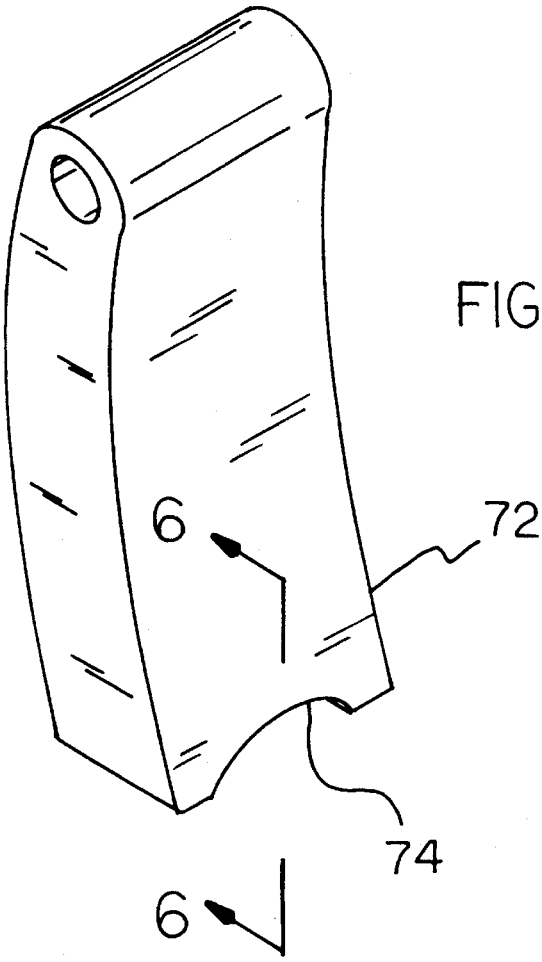
FIG. 5 is a perspective view of the flapper constructed in accordance with an alternate embodiment of the invention.
Figure 6:
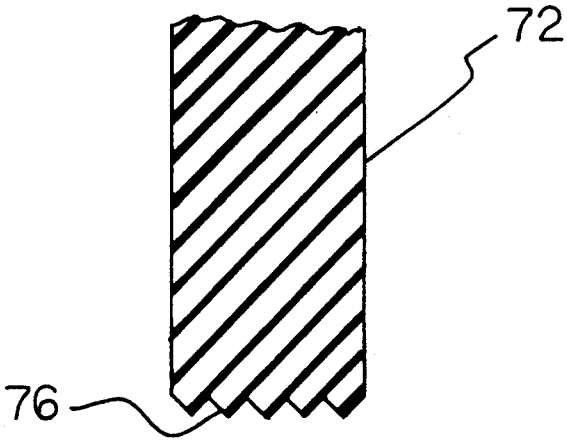
FIG. 6 is a view of the serrated end of the flapper taken along line 6—6 of FIG. 5.

In the primary embodiment of FIGS. 1–4, the curve 56 at the second or normally lower end of the flapper 54 is smooth. In the second embodiment, that of FIGS. 5 and 6, a modified flapper 72 is employed. Flapper 72 has a curve 74 at its lower end but the curve is formed with serrations 76 extending across the curve from one end to the other. This configuration increases the flapper's ability to hold the arrow shaft securely to the overdraw rest system before firing.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A device for holding an arrow to an overdraw rest system of a bow comprising:

an essentially rectangular black anodized aluminum first plate having top and bottom surfaces, opposing inner and outer edges, and opposing leading and trailing edges, the first plate further including two threaded inner edge holes disposed through the first plate and adjacent to the inner edge and two threaded outer edge holes disposed on the outer edge;

an essentially rectangular black anodized aluminum second plate having outer and inner surfaces, opposing upper and lower edges, and opposing leading and trailing edges, the second plate further including two threaded upper edge holes disposed on the upper edge and symmetrically aligned with the inner edge holes of the first plate and two threaded lower edge holes disposed through the second plate and adjacent to the lower edge;

two threaded inner edge bolts, each of said inner edge bolts disposed through one of said inner edge holes of the first plate and through one of the aligned upper edge holes of the second plate, said inner edge bolts coupling the upper edge of the second plate to the bottom surface of the first plate to define a L-shaped configuration such that the bottom surface of the first plate is adjacent to the inner surface of the second plate, with the leading edges of the first and second plates defining a common leading edge and the trailing edges of the first and second plates defining a common trailing edge;

a flapper stop pin coupled to the outer edge of the first plate and extending therefrom;

a black plastic plate having inner and outer surfaces adapted to be coupled to the outer edge of the first plate with the flapper stop pin extending therethrough, said plastic plate further including two threaded plate mounting holes disposed thereon and symmetrically aligned with the outer edge holes of the first plate and a threaded flapper mounting hole disposed between the plate mounting holes and the leading edge of the first plate;

two threaded outer edge bolts, each of said outer edge bolts disposed through one of said plate mounting holes of the plastic plate and through one of the aligned outer edge holes of the first plate, said outer edge bolts coupling the inner surface of the plastic plate to the outer edge of the first plate;

a rubber flapper having a first end, second end, and intermediate portion therebetween, the first end having a pivot hole disposed therethrough and adapted to be rotatably coupled to the outer surface of the plastic plate between the flapper stop pin and the leading edge of the first plate, the second end adapted to hold a shaft of the arrow securely to the overdraw rest system until the arrow is read to be fired, whereupon firing, the rubber flapper releases its hold of the arrow, causing the second end to rotate about the pivot hole until the intermediate portion makes contact with the flapper stop pin, thereby ensuring that the flapper does not make contact with the arrow and alter its direction of flight;

a cylindrical steel sleeve disposed within the rubber flapper pivot hole, the steel sleeve adapted to protect the pivot hole from excessive wear;

a self-locking threaded bolt disposed through the flapper mounting hole of the plastic plate for rotatably coupling the steel sleeve and the rubber flapper to the plastic plate; and two threaded mounting bolts with cooperative nuts, each of said mounting bolts disposed through one of said lower edge holes of the second plate, said mounting bolts adapted for mounting the device onto the overdraw rest system with said nuts.

* * * * *